US010580339B2

(12) United States Patent
Lim et al.

(10) Patent No.: US 10,580,339 B2
(45) Date of Patent: Mar. 3, 2020

(54) DISPLAY DEVICE AND DRIVING METHOD THEREOF

(71) Applicant: SAMSUNG DISPLAY CO., LTD., Yongin-si, Gyeonggi-Do (KR)

(72) Inventors: Woon Yong Lim, Yongin-si (KR); Ki Hyun Pyun, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 832 days.

(21) Appl. No.: 15/093,402

(22) Filed: Apr. 7, 2016

(65) Prior Publication Data

US 2016/0365066 A1 Dec. 15, 2016

(30) Foreign Application Priority Data

Jun. 12, 2015 (KR) ..... 10-2015-0083700

(51) Int. Cl.
*G09G 3/20* (2006.01)

(52) U.S. Cl.
CPC ..... *G09G 3/20* (2013.01); *G09G 2310/08* (2013.01); *G09G 2320/0223* (2013.01); *G09G 2320/0233* (2013.01)

(58) Field of Classification Search
CPC ..... G09G 3/006; G09G 3/20; G09G 3/2096; G09G 3/3266; G09G 3/3674–3681; G09G 2310/264; G09G 2310/267; G09G 2310/067; G09G 2310/08; G09G 2320/0219; G09G 2320/0223; G09G 2320/0233; G09G 2320/0242–0252
See application file for complete search history.

(56) References Cited

U.S. PATENT DOCUMENTS

2003/0098833 A1* 5/2003 Sekido ..... G09G 3/3688 345/87
2004/0252093 A1* 12/2004 Park ..... G09G 3/3688 345/94
2015/0302816 A1* 10/2015 Won ..... G09G 3/3685 345/87

FOREIGN PATENT DOCUMENTS

KR 1020010082963 8/2001
KR 1020080002564 1/2008
KR 1020090047691 5/2009
KR 1020120020799 3/2012

* cited by examiner

*Primary Examiner* — Nathan Danielsen
(74) *Attorney, Agent, or Firm* — F. Chau & Associates, LLC

(57) ABSTRACT

An exemplary embodiment of present disclosure provides a display device including a first horizontal line, a first delay line, a second delay line, a delay value determiner, and a timing controller. The first horizontal line receives a gate pulse signal (CPV) generated by a gate driver. The first delay line is connected to the first horizontal line to transmit a gate pulse signal received at a first horizontal position as a first delay signal. The second delay line is connected to the first horizontal line to transmit a gate pulse signal received at a second horizontal position as a second delay signal. The delay value determiner generates a horizontal delay signal based on the first delay signal and the second delay signal. The timing controller determines generation times of line latch signals applied to a plurality of data lines based on the horizontal delay signal.

20 Claims, 6 Drawing Sheets

DISPLAY DEVICE AND DRIVING METHOD THEREOF

CROSS-REFERENCE TO RELATED APPLICATION

This application claims priority to and the benefit of Korean Patent Application No. 10-2015-0083700, filed on Jun. 12, 2015, in the Korean Intellectual Property Office, the contents of which are herein incorporated by reference in their entirety.

TECHNICAL FIELD

The present disclosure relates to a display device and a driving method thereof, and more particularly, to a display device and a driving method thereof that include a gate line and a data line.

DISCUSSION OF RELATED ART

Display devices such as a liquid crystal display (LCD), an organic light emitting diode (OLDED) display, and the like remain in strong demand because they are light weight, thin, and have low power consumption. These display devices have been widely used in monitors, laptop computers, mobile phones, and the like. The display devices include a display panel displaying an image by using light transmittance of a liquid crystal or displaying an image by using light emission of an organic light emitting element, and a driving circuit for driving the display panel.

A display device includes a panel in which pixels are arranged in a matrix form to display an image depending on image data supplied to the panel and a driving circuit for driving the panel.

In a large display panel, a luminance difference may occur between pixels in an area A and an area B of the panel. When a gate clock signal is applied from gate drivers and disposed at a lateral portion of the panel, a signal delay gradually increases toward a center portion of the panel due to resistor-capacitor (RC) components of a panel gate wire. Gate waveforms of the lateral and center portions of the panel are different from each other, because of the signal delay occurring due to the resistor-capacitor (RC) components of the panel gate wire. Accordingly, a pixel charging rate may be different in the areas A and B and may create a luminance difference.

SUMMARY

According to an exemplary embodiment, a display device includes a first horizontal line, a first vertical line, a second vertical line, a delay value determiner, and a timing controller. The first horizontal line may receive a gate pulse signal generated by a gate driver. The first delay line may be connected to the first horizontal line to transmit a gate pulse signal received at a first horizontal position as a first delay signal. The second delay line may be connected to the first horizontal line to transmit a gate pulse signal received at a second horizontal position as a second delay signal. The delay value determiner circuit may generate a horizontal delay signal based on the first delay signal and the second delay signal. The timing controller may determine generation times of line latch signals applied to a plurality of data lines based on the horizontal delay signal.

In an exemplary embodiment, the delay value determiner circuit may include a comparison unit and a rectification unit. The comparison unit may outputs a signal difference by comparing the first delay signal and the second delay signal. The rectification unit may generate the horizontal delay signal by rectifying a signal outputted from the comparison unit.

In an exemplary embodiment, the rectification unit may include a diode.

In an exemplary embodiment, the timing controller may determine a generation time of a line latch signal applied to a first data line of the plurality of data lines to be different from a generation time of a line latch signal applied to a second data line of the plurality of data lines based on the horizontal delay signal.

In an exemplary embodiment, the timing controller may include a register, an analog-digital converter, and a line latch signal generator. The register may store division information of the horizontal delay signal. The analog-digital converter may receive the horizontal delay signal to generate a digital-converted delay value. The line latch signal generator may divide the digital-converted delay value based on the division information and may generate the line latch signals applied to the plurality of data lines based on the divided digital-converted delay values.

In an exemplary embodiment, the register may store the number of a plurality of driver ICs included in the display device as the division information, and the line latch signal generator may generate the line latch signals by differently determining a delay time per each of the plurality of driver ICs based on the division information.

In an exemplary embodiment, the line latch signals outputted from one driver IC of the plurality of driver ICs may have the same delay time.

In an exemplary embodiment, the line latch signal generator may include an interpolation circuit unit. The interpolation circuit unit may determine delay times of the line latch signals outputted from one driver IC of the plurality of driver ICs to be different from each other based on the division information.

In an exemplary embodiment, the first horizontal line may be a dummy gate line, and the first delay line and the second delay line may be each a first dummy data line and a second dummy data line.

In an exemplary embodiment, the first delay line and the second delay line may be perpendicular to the horizontal line.

According to an exemplary embodiment, the data driver provides a driving method of a display device including applying a gate pulse signal to a first horizontal line and respectively receiving a first delay signal and a second delay signal from a first delay line connected to a first position of the first horizontal line and a second delay line connected to a second position of the first horizontal line. The data driver further generates a horizontal delay signal based on the first delay signal and the second delay signal and determining generation times of line latch signals applied to a plurality of data lines based on the horizontal delay signal.

In an exemplary embodiment, the generating of the horizontal delay signal based on the first delay signal and the second delay signal may generate a difference between the first delay signal and the second delay signal as the horizontal delay signal.

In an exemplary embodiment, the determining of the generation times of the line latch signals applied to the plurality of data lines based on the horizontal delay signal may include determining a division resolution, wherein the division resolution is based on the number of driver ICs included in the display device, determining a unit delay time based on the division resolution and the horizontal delay signal and determining the generation times of the line latch signals based on the unit delay time.

In an exemplary embodiment, the determining of the generation times of the line latch signals based on the unit delay time may determine delay times of the line latch signals outputted from one driver IC of the plurality of driver ICs based on a position of the one driver IC and the unit delay time. In this case, the delay times of the line latch signals outputted from the one driver IC may be the same.

In an exemplary embodiment, the determining of the generation times of the line latch signals based on the unit delay time may determine delay times of the line latch signals outputted from one driver IC of the plurality of driver ICs based on a position of the one driver IC and the unit delay time. In this case, the determining of the generation times of the line latch signals may determine the delay times of the line latch signals outputted from the one driver IC to be different from each other by interpolating the unit time.

In an exemplary embodiment, the first delay line and the second delay line may be perpendicular to the horizontal line.

According to an exemplary embodiment, a display device includes a display panel, a gate driver, a delay value determiner circuit and a timing controller. The display device may include a first horizontal line. The gate driver may transmit a gate pulse signal to the first horizontal line. The delay value determiner circuit may be electrically connected to the first horizontal line at a first position and a second position. The delay value determiner circuit receives the gate pulse signal from the first position as a first delay signal and the second position as a second delay signal and generates a horizontal delay signal based on the first delay signal and the second delay signal. The timing controller may determine generation times of line latch signals applied to a plurality of data lines based on the horizontal delay signal.

In an exemplary embodiment, the first delay line may connect the first position on the first horizontal line to the delay value determiner circuit and the second delay line may connect the second position on the first horizontal line to the delay value determiner circuit. The first delay line and the second delay line may be perpendicular to the first horizontal line.

In an exemplary embodiment, the delay value determiner circuit may include a comparator to output a signal difference by comparing the first delay signal and the second delay signal and a rectifier to generate the horizontal delay signal by rectifying a signal outputted from the comparison unit.

According to an exemplary embodiment, a display device includes a display panel, a gate driver, a delay value determiner circuit and a timing controller. The display device may include a plurality of horizontal lines. The delay value determiner circuit may be electrically connected to each of the plurality of horizontal lines at a first position and a second position. The delay value determiner circuit may receive the gate pulse signal from the first position as a first delay signal and the second position as a second delay signal for each of the plurality of horizontal lines and may generate a horizontal delay signal based on the first delay signal and the second delay signal for each of the plurality of horizontal lines. The timing controller may determine generation times of line latch signals applied to a plurality of data lines based on the horizontal delay signal for each of the plurality of horizontal lines.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
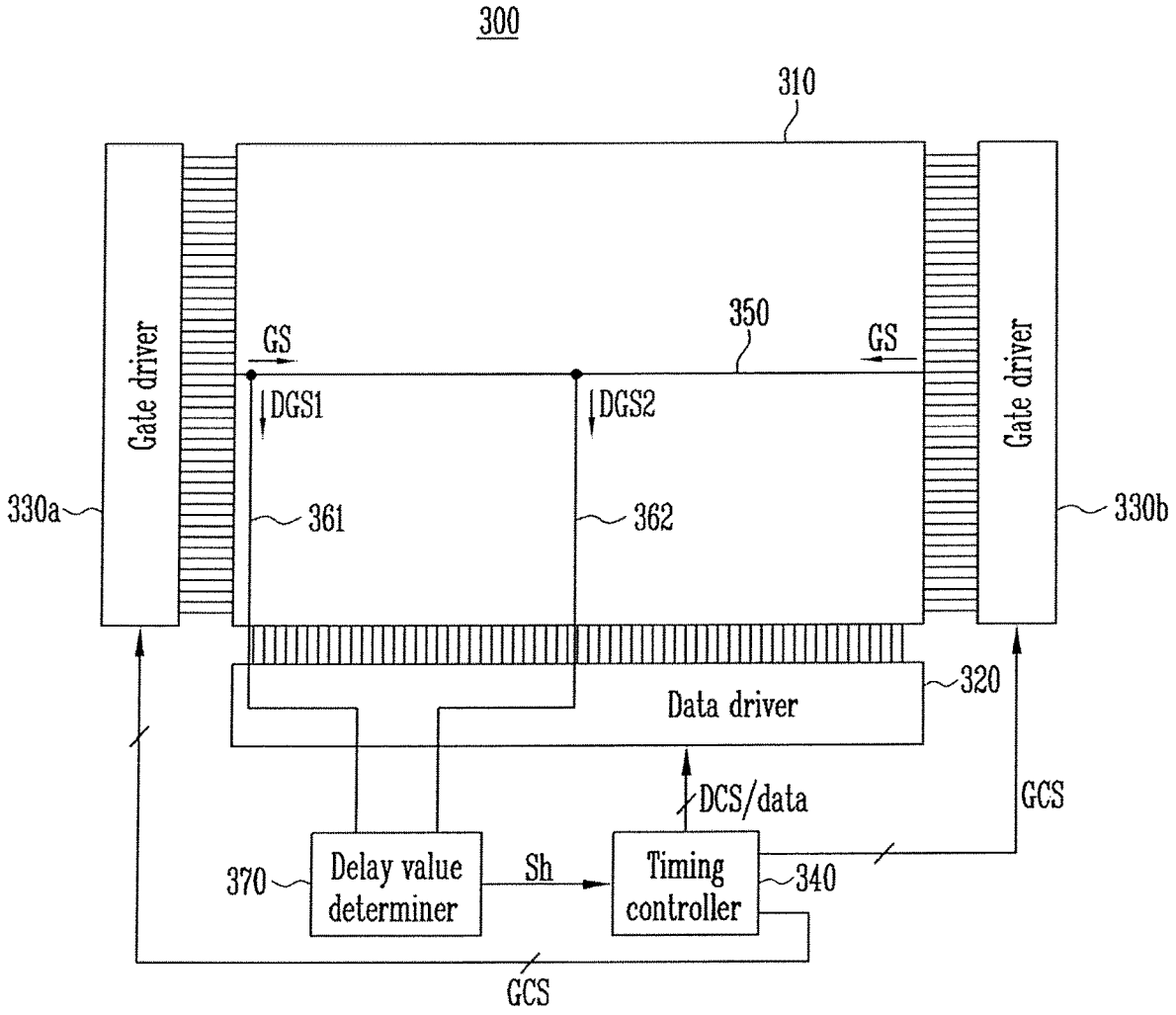
FIG. 1 illustrates a schematic diagram of a display device according to an exemplary embodiment of the present disclosure.

Hereinafter, exemplary embodiments of the present disclosure will be described in detail with reference to the attached drawings. The drawings and description are to be regarded as illustrative in nature and not restrictive. Like reference numerals designate like elements throughout the specification. To clearly describe the present disclosure, parts that are irrelevant to the description are omitted. As those skilled in the art would realize, the described embodiments may be modified in various different ways, all without departing from the spirit or scope of the present disclosure. Exemplary embodiments described in the specification are provided so that the spirit or scope of the present disclosure can be easily put into practice by those skilled in the art. FIG. 1 illustrates a schematic diagram of a display device according to an exemplary embodiment of the present disclosure.

Referring to FIG. 1, a display panel 300 according to an exemplary embodiment of the present disclosure includes a panel 310 in which pixels are arranged in a matrix form to display an image depending on image data (data voltage) supplied to the panel and a driving circuit for driving the display panel 300.

The driving circuit may include a data driver 320, gate drivers 330*a* and 330*b*, a timing controller 340, and a delay value determiner 370. Further, the display device 300 according to the exemplary embodiment of the present disclosure may include a first horizontal line 350, a first delay line 361, and a second delay line 362.

A gate signal (GS) is applied to the first horizontal line 350 from the gate drivers 330*a* and 330*b*. The gate signal (GS) may be a gate clock signal (CPV). When the panel 310 is large, the gate signal (GS) may be delayed while being transmitted in the first horizontal line 350. In the present exemplary embodiment, the first horizontal line 350 may be a dummy gate line.

The first delay line 361 and the second delay line 362 are connected to the first horizontal line 350. The first delay line 361 may be connected to the first horizontal line 350 at a first horizontal position. The first delay line 361 and the second delay line 362 may be substantially perpendicular to the first horizontal line 350. As shown in FIG. 1, the first horizontal position may be an edge of the panel 310, for example, a horizontal position close to the gate driver 330*a*. The second delay line 362 may be connected to the first horizontal line 350 at a second horizontal position. As shown in FIG. 1, the second horizontal position may be a center position of the panel 310, for example, a farthest horizontal position from the gate drivers 330*a* and 330*b*.

As described above, when the gate signal (GS) is applied to the first horizontal line 350, a delay time thereof may be changed depending to the horizontal positions. For example, the delay time of the gate signal (GS) received at the second horizontal position to which the second delay line 362 is connected may be longer than the delay time of the gate signal (GS) received at the first horizontal position to which the first delay line 361 is connected.

The gate signal (GS) received at the first horizontal position of the first horizontal line 350 is a first delay signal DGS1 which may be transmitted through the first delay line 361. The gate signal (GS) received at the second horizontal position of the first horizontal line 350 is a second delay signal DGS2 which may be transmitted through the second delay line 362. Accordingly, the second delay signal DGS2 has a longer delay time than the first delay signal DGS1. For example, since the first delay signal DGS1 is a gate signal (GS) generated at the first horizontal position close to the gate driver 330*a*, its delay time may be relatively short or about 0. Since the second delay signal DGS2 is a gate signal (GS) generated at the farthest second horizontal position from the gate drivers 330*a* and 330*b*, its delay time may be relatively long. For example, when the second horizontal position is the center horizontal position of the panel 310, the second delay signal DGS2 may have a maximum delay time.

The first delay signal DGS1 and the second delay signal DGS2 are transmitted to the delay value determiner 370. The delay value determiner may be implemented in hardware, e.g. a delay value determiner circuit, or software. The delay value determiner 370 may generate a horizontal delay signal Sh based on the first delay signal DGS1 and the second delay signal DGS2. The horizontal delay signal Sh may be a difference between the delay time of the first delay signal DGS1 and the delay time of the second delay signal DGS2.

The timing controller 340 may determine generation times of line latch signals applied to a plurality of data lines of the panel 310 through the data driver 320 based on the horizontal delay signal Sh generated by the delay value determiner 370. For example, the line latch signals are included in a data control signal (DCS) to be transmitted to the data driver 320 from the timing controller 340. The line latch signals transmitted to data driver 320 may be applied to the plurality of data lines of the panel 310. The timing controller 340 according to the present exemplary embodiment may determine the generation times of the line latch signals respectively applied to the plurality of data lines based on the horizontal delay signal Sh. For example, the timing controller 340 may apply line latch signals having a relatively short delay time to data lines relatively close to the gate drivers 330*a* and 330*b*, and apply line latch signals having a relatively long delay time to data lines relatively remote from the gate drivers 330*a* and 330*b*. Accordingly, times when the line latch signals are applied are determined based on a signal delay time measured through the first horizontal line 350, this compensates for a charging rate deviation due to the RC delay of the gate line.

Configuration and operation of the delay value determiner 370 will be described in detail with reference to FIGS. 2 and 3 below. Configuration and operation of the timing controller 340 will be described in detail with reference to FIGS. 4 to 8 below.

According to an exemplary embodiment, the display panel includes one or more horizontal lines. Each horizontal line is connected to the delay value determiner at a first horizontal position and a second horizontal position on the display panel. The delay value determiner ascertains a delay value for each data line based on each horizontal line.

Figure 2:
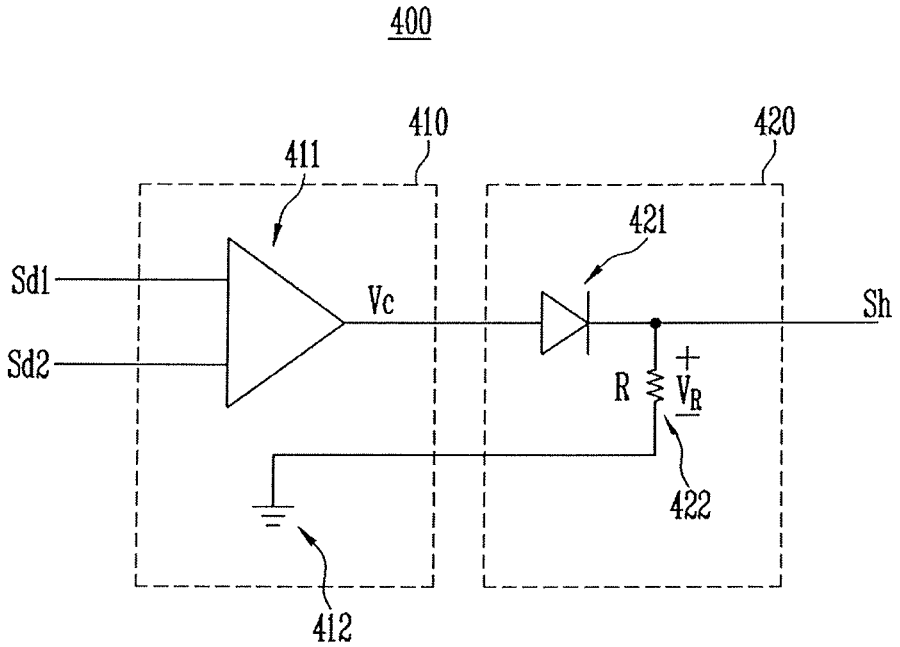
FIG. 2 illustrates a circuit diagram of a delay value determiner included in a display device according to an exemplary embodiment of the present disclosure.

FIG. 2 illustrates a circuit diagram of a delay value determiner included in a display device according to an exemplary embodiment of the present disclosure.

Referring to FIG. 2, a delay value determiner 400 may include a comparison unit 410 and a rectification unit 420. The comparison unit 410 may include a comparator 411 comparing a first delay signal Sd1 and a second delay signal Sd2 and a ground terminal 412. Herein, the first delay signal Sd1 inputted to the comparison unit 410 may be the first delay signal DGS1 shown in FIG. 1. The second delay signal Sd2 inputted to the comparison unit 410 may be the second delay signal DGS2 shown in FIG. 1. The comparator 411 outputs a difference between the first delay signal Sd1 and the second delay signal Sd2 as an output signal (Vc).

The rectification unit 420 may rectify the output signal (Vc) outputted from the comparison unit 410. For example, the rectification unit 420 may remove a negative component of the output signal (Vc) outputted from the comparison unit 410. For this purpose, the rectification unit 420 may include a diode 421 and output resistors (R, 422). The rectification unit 420 may output a voltage (VR) between opposite ends of the output resistor 422 as a horizontal delay signal Sh.

The delay value determiner shown in FIG. 2 is only an example, and accordingly, the delay value determiner of the display device according to the present disclosure is not limited to the configuration of FIG. 2. Various configurations that can output a difference between the first delay signal and the second delay signals outputted from different horizontal positions may be used in addition to the configuration of FIG. 2.

Figure 3:
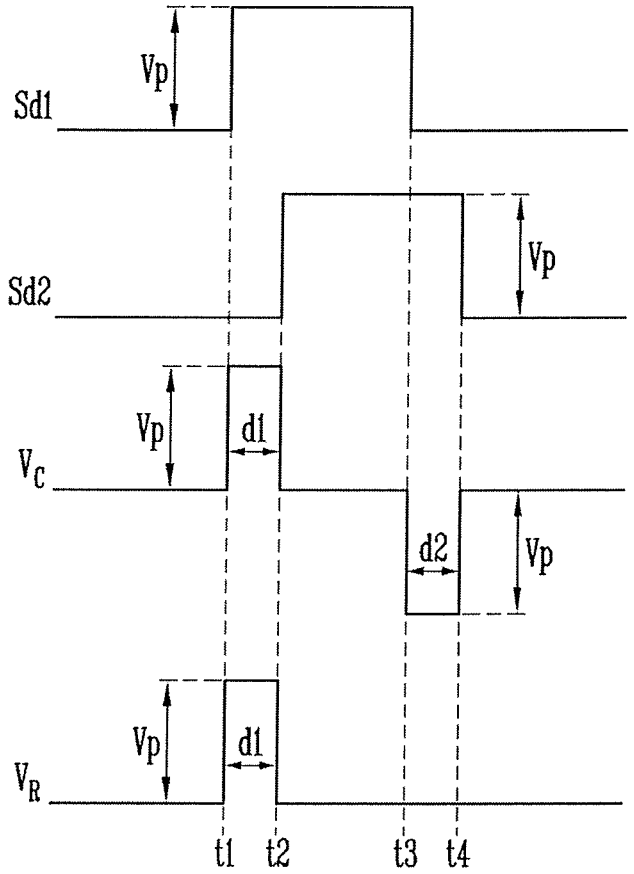
FIG. 3 illustrates a timing diagram of explaining horizontal delay signals generated by the delay value determiner shown in FIG. 2.

FIG. 3 illustrates a timing diagram of explaining horizontal delay signals generated by the delay value determiner shown in FIG. 2.

The first delay signal Sd1 and the second delay signal Sd2 inputted to the comparison unit 410, the output signal (Vc) outputted from the comparison unit 410, and the voltage (VR) applied to the output resistor 422 of the rectification unit 420 are shown in FIG. 2 or FIG. 3.

The first delay signal Sd1 may be a delay signal transmitted through the first delay line from an edge of the panel, for example, from the first horizontal position close to the gate driver. The second delay signal Sd2 may be a delay signal transmitted through the second delay line from a center of the panel, for example, from the farthest second horizontal position from the gate driver. Accordingly, a delay time of the first delay signal Sd1 may be shorter than that of the second delay signal Sd2.

For example, the first delay signal Sd1 may be activated at time t1, and deactivated at time t3. The second delay signal Sd2 may be activated at time t2 which is delayed by an interval d1 from the time t1, and deactivated at time t4 which is delayed by an interval d2 from the time t3. The first delay signal Sd1 and the second delay signal Sd2 may include a peak value of Vp. In the above-described contents, the interval d1 may be equal to the interval d2.

The comparator 411 receives the first delay signal Sd1 and the second delay signal Sd2 and then inputs a difference between the first delay signal Sd1 and the second delay signal Sd2. Accordingly, the output signal (Vc) of the comparator 411 rises up at the time t1 to Vp, and after the interval d1 passes, it falls down at the time t2 to about 0. The output signal (Vc) of the comparator 411 falls down at the time t3 to −Vp, and after the interval d2 passes, it rises up at the time t4 to about 0.

The rectification unit 420 may rectify the output signal (Vc) of the comparison unit 410. When the output signal (Vc) of the comparison unit 410 is the positive value of Vp, the diode 421 operates as a short circuit, thus the total voltage Vp of the output signal (Vc) is applied to the output resistor 422. Accordingly, in this case, the voltage applied to the output resistor 422 of the comparison unit 420 is outputted as the horizontal delay signal Sh. Since the output signal (Vc) of the comparison unit 410 is positive during the times t1 to t2, the voltage of the output signal (Vc) is applied to the output resistor 422. Accordingly, the rectification unit 420 directly outputs the output signal (Vc) of the comparison unit 410 as the horizontal delay signal Sh during the times t1 to t2.

When the output signal (Vc) of the comparison unit 410 has the negative value of −Vp, the diode 421 operates as an open circuit, and current does not flow through the output resistor 422. Accordingly, in this case, a zero voltage is outputted as the horizontal delay signal Sh. Since the output signal (Vc) of the comparison unit 410 is negative during the times t3 to t4, the voltage (−Vp) of the output signal (Vc) is not applied to the output resistor 422 but the diode 421. Accordingly, a zero voltage is applied to the output resistor 422, and the zero voltage is outputted as the horizontal delay signal Sh.

Referring to the signals (Sd1, Sd2, Vc, and Vp) illustrated in FIG. 3, a delay period difference between the first delay signal Sd1 and the second delay signal Sd2 is identified at the output resistor 422, and the signal corresponding to the delay period difference is outputted as the horizontal delay signal Sh. The horizontal delay signal Sh includes the peak voltage of Vp, and it is activated during a period corresponding to the delay period difference between the first delay signal Sd1 and the second delay signal Sd2. The horizontal delay signal Sh is applied to the timing controller, and the timing controller determines the generation times of the line latch signals applied to the plurality of data lines based on the horizontal delay signal Sh.

Figure 4:
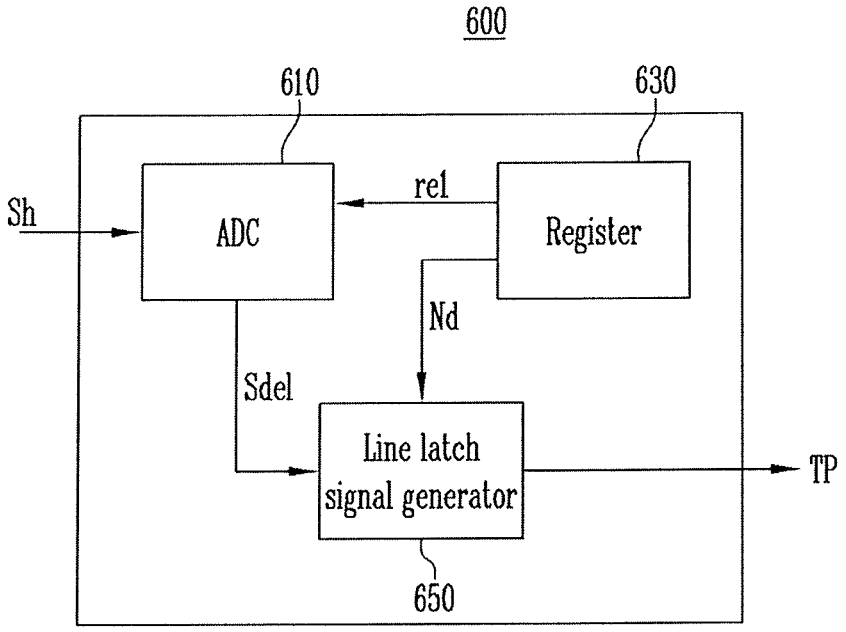
FIG. 4 illustrates a block diagram of a timing controller included in a display device according to an exemplary embodiment of the present disclosure.

FIG. 4 illustrates a block diagram of a timing controller included in a display device according to an exemplary embodiment of the present disclosure.

Referring to FIG. 4, a timing controller 600 may include an analog-digital converter (ADC) 610, a register 630, and a line latch signal generator 650.

The ADC 610 receives the horizontal delay signal Sh and then generates a digital-converted delay value Sde1. For example, the ADC 610 may generate the digital-converted delay value by integrating the horizontal delay signal Sh transmitted from the delay value determiner over a predetermined period. Referring to FIG. 3, the voltage (VR) of the output resistor is output as the horizontal delay signal Sh. The greater the difference d1 between the delay time of the first delay signal Sd1 and the second delay signal Sd2, the greater the value resulting from integrating the horizontal delay signal. Accordingly, the digital-converted delay value Sde1 may be generated by converting the value resulting from integrating the horizontal delay signal Sh into a digital value. The digital-converted delay value Sde1 is transmitted to the line latch signal generator 650.

The register 630 may store division information of the horizontal delay signal Sh. The division information may include a division resolution re1 in which the horizontal delay signal Sh is divided, number information Nd of the data driver, and the like. The division information may be transmitted to the ADC 610 or the line latch signal generator 650. In the present exemplary embodiment, the division information may be stored with a predetermined value.

The line latch signal generator 650 may divide the digital-converted delay value Sde1 based on the division information transmitted from the register 630. In this case, the division resolution re1 transmitted to the ADC 610 may be also transmitted to the line latch signal generator 650. The line latch signal generator 650 may divide the digital-converted delay value Sde1 into several sections based on the division information. The division resolution re1 may be randomly determined. In the present exemplary embodiment, the division resolution re1 may be determined depending on the number of the data driver ICs included in the data driver of the display device. In this case, the generation times of the line latch signals outputted from the same data driver ICs may be substantially the same, and the generation times of the line latch signals outputted from the different data driver ICs may be different from each other. In the present exemplary embodiment, the generation time of the line latch signal outputted from the data driver IC positioned at the center of the panel may be later than that of the line latch signal outputted from the data driver IC positioned at the lateral surface of the panel.

An exemplary embodiment in which the division resolution re1 is determined by the number of the data driver ICs included in the data driver of the display device will be described with reference to FIGS. 5 and 6.

Figure 5:
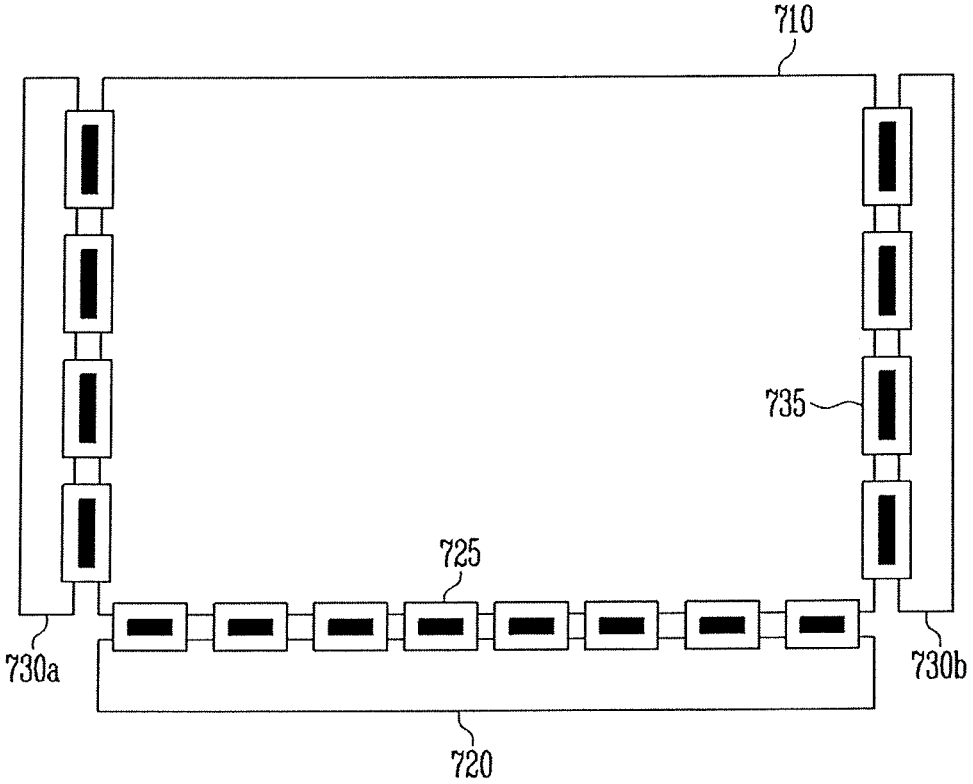
FIG. 5 illustrates a schematic diagram of a display device including a plurality of gate driver ICs and a plurality of driver ICs according to an exemplary embodiment of the present disclosure.

FIG. 5 illustrates a schematic diagram of the display device including the plurality of gate driver ICs and the plurality of driver ICs according to the exemplary embodiment of the present disclosure.

Referring to FIG. 5, a display device 700 includes a panel 710, a data driver 720, and gate drivers 730*a* and 730*b*. The data driver 720 includes a plurality of data driver ICs 725. The gate drivers 730*a* and 730*b* respectively include a plurality of gate driver ICs 735. The data driver 720 includes a total of eight data driver ICs 725 in the exemplary embodiment of FIG. 5.

For better understanding and ease of description, the eight data driver ICs 725 are referred to as a first data driver IC, a second data driver IC, . . . , an eighth data driver IC, from the leftmost side. For example, the closest data driver ICs to the gate drivers 730*a* and 730*b* are the first and eighth data driver ICs, and the farthest data driver ICs form the gate drivers 730*a* and 730*b* are the fourth and fifth data driver ICs.

In the display device 700 according to the exemplary embodiment of the present disclosure, the line latch signals outputted from the same data driver ICs are substantially the same delay value. The generation times of the line latch signals outputted from the different data driver ICs may be different from each other.

Figure 6:
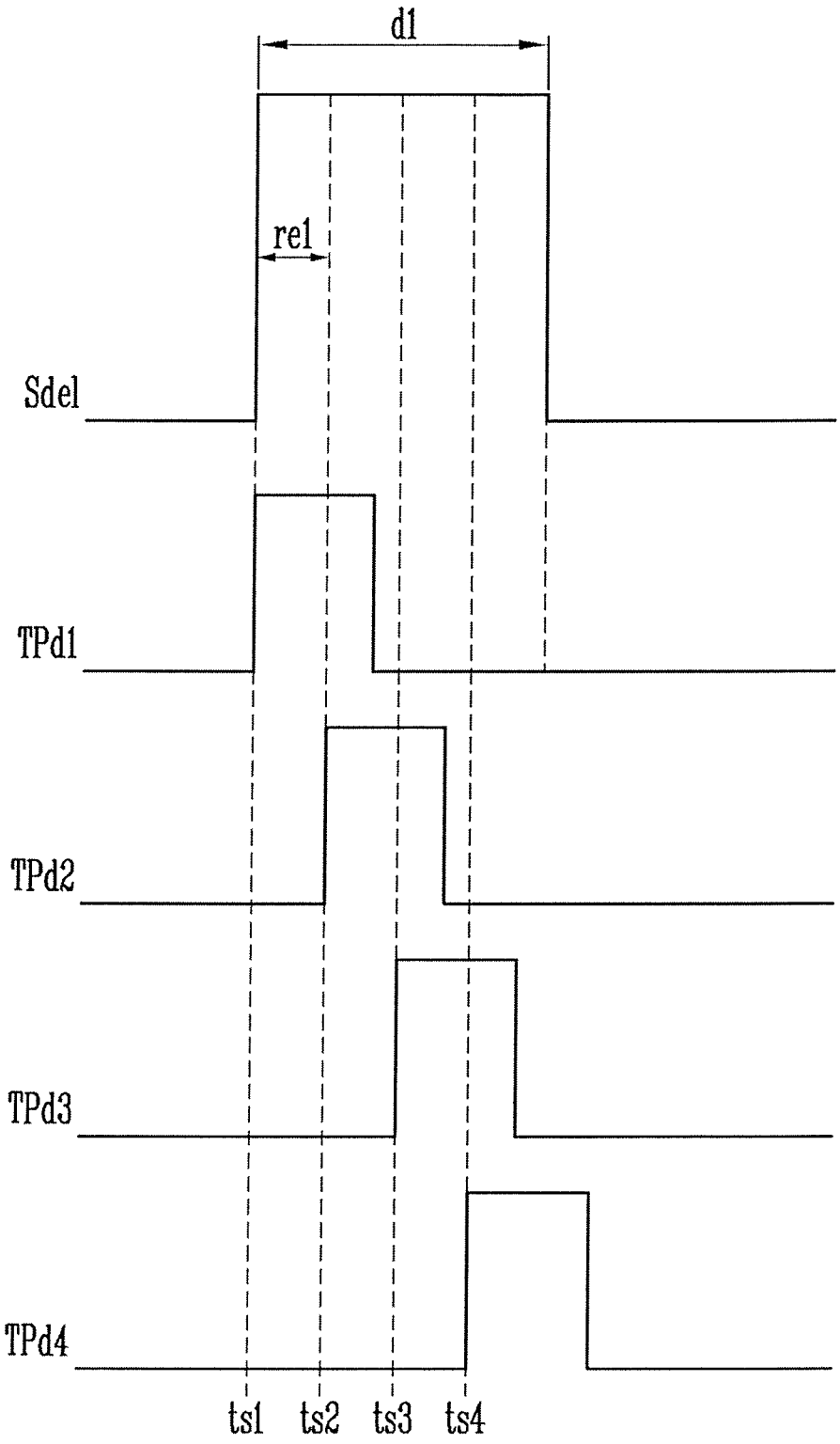
FIG. 6 illustrates a timing diagram of explaining horizontal delay signals and line latch signals of the display device shown in FIG. 5.

FIG. 6 illustrates a timing diagram of explaining the horizontal delay signals and the line latch signals of the display device shown in FIG. 5.

Referring to FIG. 6 in addition to FIG. 5, the digital-converted delay value Sde1 includes a delay period d1, and the division resolution re1 may be a quarter of the delay period d1. In the display device 700 shown in FIG. 5, the eight data driver ICs 725 are included in the data driver 720, and the gate drivers 730*a* and 730*b* are disposed at the opposite sides of the panel, thus the division resolution re1 may be a 4, where the delay period d1 8 is divided by the number of gate drivers 2. In the display device 700 shown in FIG. 5, if the gate driver is disposed at only the left side of the panel, the division resolution re1 may be a 8, where the delay period d1 8 is divided by the number of gate drivers 1.

Line latch signals (TPd1, TPd2, TPd3, and TPd4) having four different activated times depending on the digital-converted delay value Sde1 and the division resolution re1 are shown in FIG. 6. The first line latch signal TPd1 may be activated at time ts1, and the second line latch signal TPd2 may be activated at time ts2. Further, the third line latch signal TPd3 may be activated at time ts3, and the fourth line latch signal TPd4 may be activated at time ts4.

The first line latch signal TPd1 may be the line latch signals outputted from the first and eighth data driver ICs among the data driver ICs shown in FIG. 5. The second line latch signal TPd2 may be the line latch signals outputted from the second and seventh data driver ICs among the data driver ICs shown in FIG. 5. The third line latch signal TPd3 may be the line latch signals outputted from the third and sixth data driver ICs among the data driver ICs shown in FIG. 5. The fourth line latch signal TPd4 may be the line latch signals outputted from the fourth and fifth data driver ICs among the data driver ICs shown in FIG. 5. In this case, the line latch signals outputted from the same data driver ICs may be activated at substantially the same time. For example, the line latch signals outputted from the first data driver IC are activated at the time ts1. The line latch signals outputted from the second data driver IC is activated at the time ts2 delayed by the division resolution re1 from the time ts1. The line latch signals outputted from the third data driver IC is activated at the time ts3 delayed by the division resolution re1 from the time ts2. The line latch signals outputted from the fourth data driver IC is activated at the time ts4 delayed by the division resolution re1 from the time ts3.

According to the exemplary embodiments of the present disclosure described above, the line latch signals are first applied to the data lines connected to the data driver ICs disposed at the edge of the panel, and the line latch signals delayed by the division resolution re1 are applied to the data lines connected to respective data driver ICs as close to the center of the panel. Accordingly, the charging rate difference caused by the RC delay due to the long gate line associated with the enlargement of the panel may be compensated. For example, when the gate signal is delayed as close to the center of the panel, it is possible to substantially decrease the charging rate difference by applying the latch signal to the data line after delaying the line latch signal and improve image quality.

Figure 7:
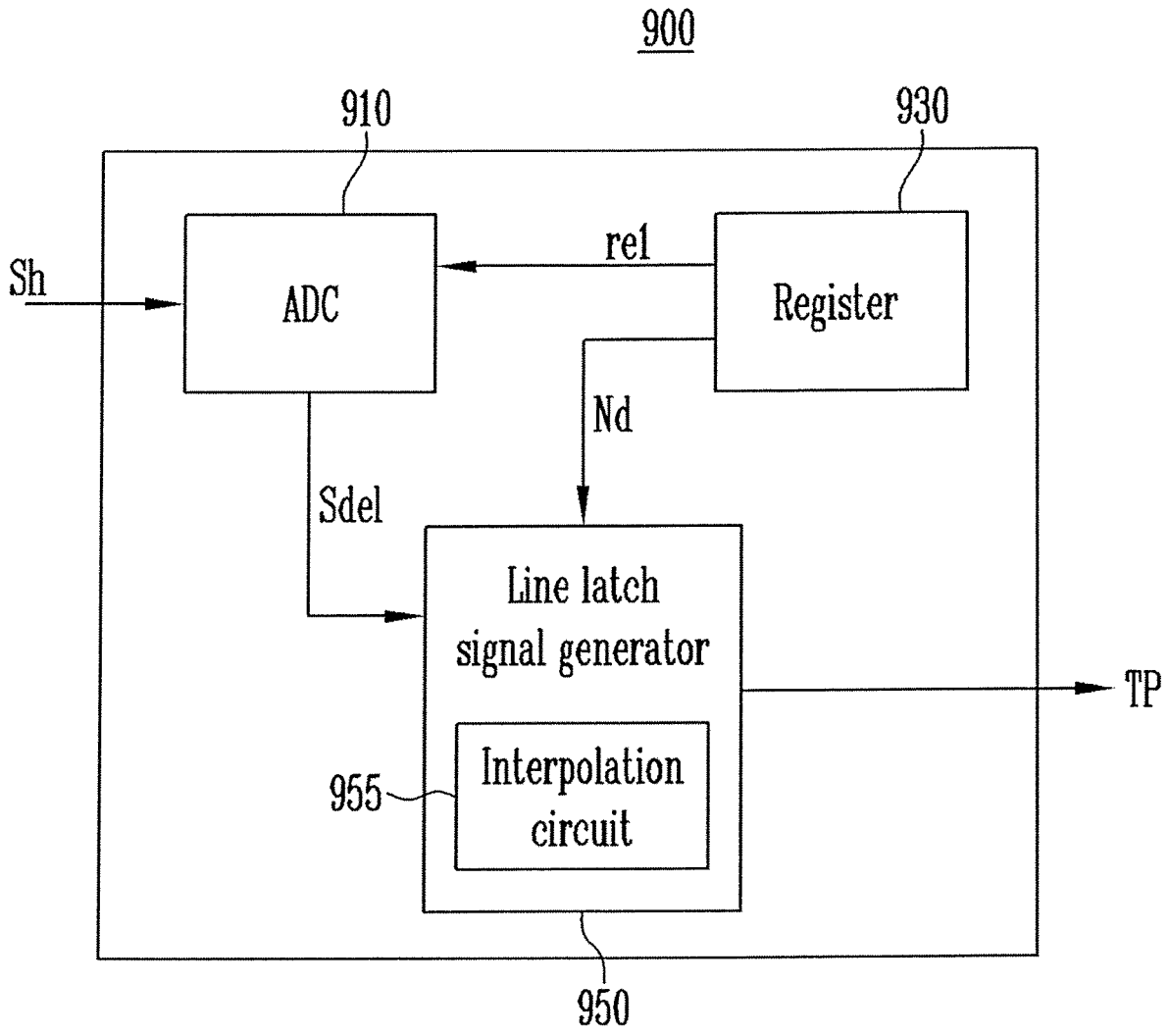
FIG. 7 illustrates a block diagram of another timing controller included in a display device according to an exemplary embodiment of the present disclosure.

FIG. 7 illustrates a block diagram of another timing controller included in the display device according to the exemplary embodiment of the present disclosure.

Referring to FIG. 7, a timing controller 900 may include an ADC 910, a register 930, and a line latch signal generator 950. The line latch signal generator 950 may include an interpolation circuit 955.

Configuration and operation of the ADC 910 and the register 930 of the timing controller 900 shown in FIG. 7 may be the same as those of the ADC 610 and the register 630 shown in FIG. 4. Accordingly, the detailed description of the ADC 910 and the register 930 among constituent elements shown in FIG. 7 will be omitted.

The line latch signal generator 950 of FIG. 7 is different from the line latch signal generator 950 of FIG. 4 in that the line latch signal generator 950 of FIG. 7 includes an interpolation circuit 955. In the exemplary embodiment of FIG. 4, the line latch signal generator 650 applies the line latch signals to the data lines connected to the same data driver ICs at the same time. On the other hand, the interpolation circuit 955 included in the line latch signal generator 950 of FIG. 7 may interpolate the digital-converted delay value received from the ADC 910 to be suitable for the number of the data lines of the data driver IC to generate line latch signals having delay values corresponding to respective data lines.

Figure 8:
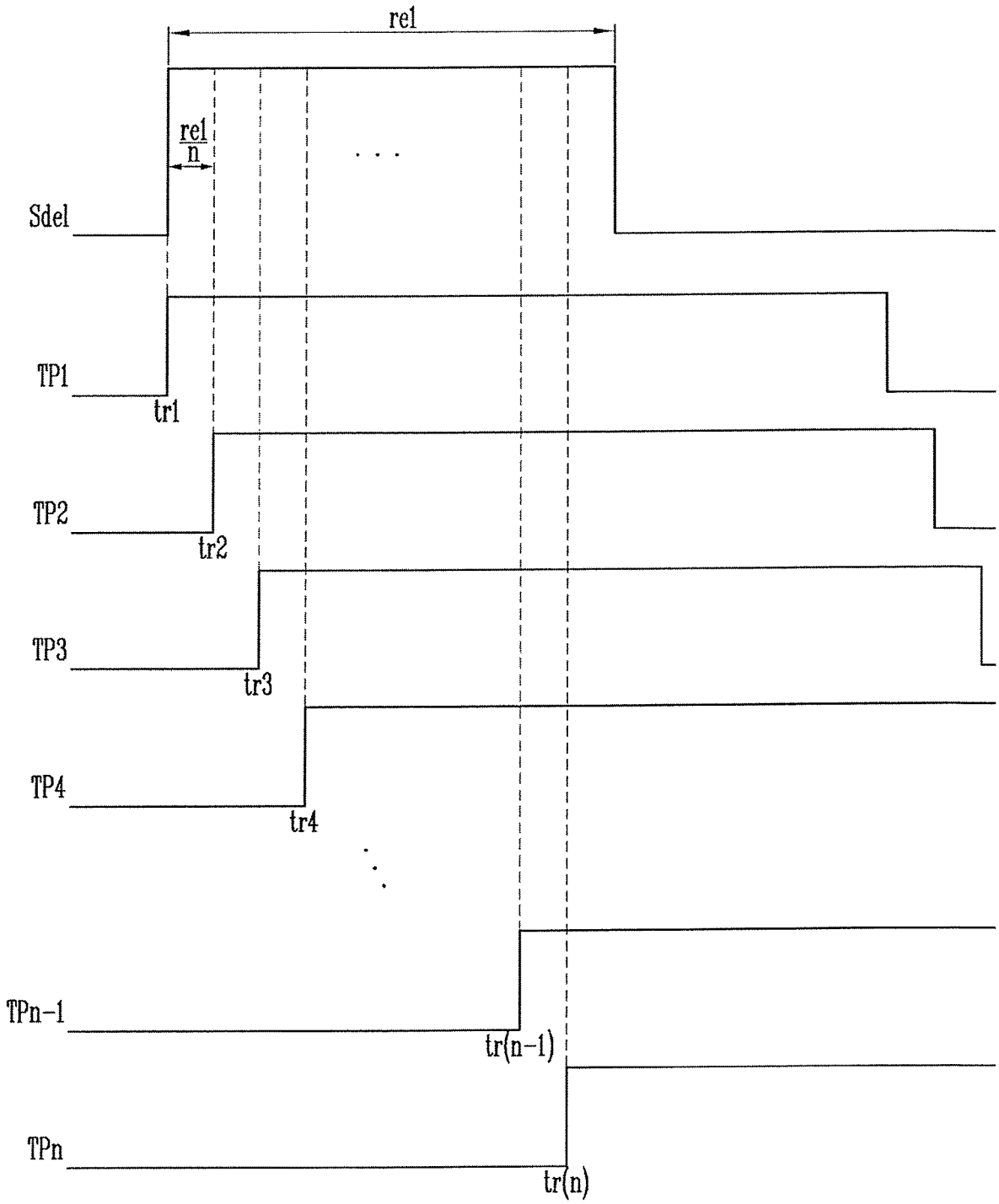
FIG. 8 illustrates a timing diagram of explaining horizontal delay signals and line latch signals of the display device shown in FIG. 5.

FIG. 8 illustrates a timing diagram of explaining the horizontal delay signals and the line latch signals of the display device shown in FIG. 5.

Referring to FIG. 8, the digital-converted delay value Sde1 divided into the division resolution re1 is further divided by the interpolation circuit 955 of FIG. 7, such that the line latch signals may be applied to the data lines at different times even in the same data driver IC. Line latch signals applied to n data lines connected to the first data driver IC are shown in FIG. 8.

The digital-converted delay value Sde1 divided into the division resolution re1 may be further divided into n numbers by the interpolation circuit 955. The line latch signals (TP1, TP2, . . . , TPn) shown in FIG. 8 may be the line latch signals applied to the n data lines connected to the data driver IC positioned at the leftmost side of the data driver ICs of FIG. 5. According to the exemplary embodiments of FIGS. 4 and 6, the line latch signals applied to the n data lines connected to the data driver IC positioned at the leftmost side of the data driver ICs of FIG. 5 may be activated at substantially the same time. However, according to the exemplary embodiments of FIGS. 7 and 8, the line latch signals applied to the n data lines connected to the data driver IC positioned at the leftmost side of the data driver ICs of FIG. 5 are respectively activated at different times by the interpolation circuit 955.

The division resolution re1 may be more minutely divided into a resolution of (re1/n) by the interpolation circuit 955. For example, the line latch signal TP1 applied to the first data line positioned at the leftmost side of the data driver ICs is activated at time tr1, and the line latch signal TP2 applied to the second data line adjacent to the right of the first data line is activated at time tr2 delayed by the resolution of (re1/n) from the time tr1. Similarly, the line latch signal TP3 applied to the third data line adjacent to the right of the second data line is activated at time tr3 delayed by the resolution of (re1/n) from the time tr2, and the line latch signal TP4 applied to the fourth data line adjacent to the right of the third data line is activated at time tr4 delayed by the resolution of (re1/n) from the time tr3.

In this way, a line latch signal (TPn−1) applied to a (n−1)-th data line is activated at time tr (n−1), and a line latch signal (TPn) applied to a n-th data line is activated at time tr (n). When the line latch signal (TPn) applied to the n-the data line is activated, all of the line latch signals applied to the data lines connected to the first data driver IC are activated, and then the line latch signals applied to the data lines connected to the second data driver IC starts to be activated at times delayed by the resolution of (re1/n) from the time tr (n).

According to the exemplary embodiments shown in FIGS. 7 and 8, the line latch signals are delayed and applied in the more minute resolution of (re1/n) by the interpolation circuit 955 even in the same data driver IC, and may more precisely perform the charging rate compensation due to the gate signal delay and improving image quality of the display device.

Exemplary embodiments may be implemented by software or hardware components such as a field-programmable gate array (FPGA) or an application-specific integrated circuit (ASIC). However, exemplary embodiments are not limited to software or hardware. Exemplary embodiments may include a storage medium capable of addressing, or may be configured to be executed by one or more processors. Exemplary embodiments may include object-oriented software components, class components, and task components, and processes, functions, attributes, procedures, subroutines, segments of a program code, drivers, firmware, a micro code, a circuit, data, a database, data structures, tables, arrays, and variables. Functions provided by different components may be combined into a smaller number of components or may be further separated into additional components. Further, the components may be configured to operate one or more CPUs included in devices or secure multimedia cards.

Example embodiments have been disclosed herein and although specific terms are employed, they are used and are to be interpreted in a generic and descriptive sense only and not for purpose of limitation. In some instances, as would be apparent to one of ordinary skill in the art as of the filing of the present application, features, characteristics and/or elements described in connection with a particular embodiment may be used singly or in combination with features, characteristics and/or elements described in connection with other embodiments unless otherwise indicated. Accordingly, it will be understood by those of skill in the art that various changes in form and details may be made without departing from the spirit and scope of the present disclosure as set forth in the following claims.

What is claimed is:

1. A display device comprising:

a first horizontal line configured to receive a gate pulse signal generated by a gate driver;

a first delay line configured to be connected to the first horizontal line to transmit a gate pulse signal received at a first horizontal position as a first delay signal;

a second delay line configured to be connected to the first horizontal line to transmit a gate pulse signal received at a second horizontal position as a second delay signal;

a delay value determiner circuit configured to generate a horizontal delay signal based on the first delay signal and the second delay signal; and a timing controller configured to determine generation times of line latch signals applied to a plurality of data lines based on the horizontal delay signal, wherein the delay value determiner circuit includes:

a comparison unit configured to output a signal difference by comparing the first delay signal and the second delay signal; and a rectification unit configured to generate the horizontal delay signal by rectifying a signal outputted from the comparison unit.

2. The display device of claim 1, wherein the rectification unit includes a diode.

3. The display device of claim 1, wherein the timing controller determines a generation time of a line latch signal applied to a first data line of the plurality of data lines to be different from a generation time of a line latch signal applied to a second data line of the plurality of data lines based on the horizontal delay signal.

4. The display device of claim 1, wherein the first delay line and the second delay line are perpendicular to the horizontal line.

5. The display device of claim 1, further comprising:

a display panel including the first horizontal.

6. The display device of claim 1 wherein the timing controller is configured to determine delay times of the line latch signals output from one driver IC of a plurality of driver ICs to be different from each other based on division information of the horizontal delay signal.

7. The display device of claim 1, the timing controller comprising:

an analog-digital converter configured to receive the horizontal delay signal to generate a digital-converted delay value; and a line latch signal generator configured to divide the digital-converted delay value based on the division information and to generate the line latch signals applied to the plurality of data lines based on the divided digital-converted delay values, to generate the line latch signals by differently determining a delay time per each of the plurality of driver ICs based on the division information, and to determine delay times of the line latch signals output from one driver IC of the plurality of driver ICs to be different from each other based on the division information.

8. The display device of claim 7, wherein:

the line latch signal generator includes an interpolation circuit unit, and the interpolation circuit unit determines delay times of the line latch signals output from one driver IC of the plurality of driver ICs to be different from each other based on the division information.

9. A display device comprising:

a first horizontal line configured to receive a gate pulse signal generated by a gate driver;

a first delay line configured to be connected to the first horizontal line to transmit a gate pulse signal received at a first horizontal position as a first delay signal;

a second delay line configured to be connected to the first horizontal line to transmit a gate pulse signal received at a second horizontal position as a second delay signal;

a delay value determiner circuit configured to generate a horizontal delay signal based on the first delay signal and the second delay signal; and a timing controller configure to determine generation times of line latch signals applied to a plurality of data lines based on the horizontal delay signal, wherein the timing controller includes a register configured to store division information of the horizontal delay signal;

an analog-digital converter configured to receive the horizontal delay signal to generate a digital-converted delay value; and a line latch signal generator configured to divide the digital-converted delay value based on the division information and to generate the line latch signals applied to the plurality of data lines based on the divided digital-converted delay values.

10. The display device of claim 9, wherein the register stores the number of a plurality of driver ICs included in the display device as the division information, and the line latch signal generator generates the line latch signals by differently determining a delay time per each of the plurality of driver ICs based on the division information.

11. The display device of claim 10, wherein the line latch signals output from one driver IC of the plurality of driver ICs have the same delay time.

12. The display device of claim 10, wherein the line latch signal generator includes an interpolation circuit unit, and the interpolation circuit unit determines delay times of the line latch signals output from one driver IC of the plurality of driver ICs to be different from each other based on the division information.

13. The display device of claim 9, wherein the first delay line is configured to connect the first horizontal position on the first horizontal line to the delay value determiner circuit;

wherein the second delay line is configured to connect the second horizontal position on the first horizontal line to the delay value determiner circuit, and wherein the first delay line and the second delay line are perpendicular to the first horizontal line.

14. The display device of claim 9, wherein the delay value determiner circuit includes a comparator to output a signal difference by comparing the first delay signal and the second delay signal; and a rectifier to generate the horizontal delay signal by rectifying a signal outputted from the comparator.

15. The display device of claim 9 wherein the timing controller is configured to determine delay times of the line latch signals output from one driver IC of a plurality of driver ICs to be different from each other based on division information of the horizontal delay signal.

16. The display device of claim 9, further comprising a display panel including the first horizontal line.

17. A display device comprising:

a first horizontal line configured to receive a gate pulse signal generated by a gate driver;

a first delay line configured to be connected to the first horizontal line to transmit a gate pulse signal received at a first horizontal position as a first delay signal;

a second delay line configured to be connected to the first horizontal line to transmit a gate pulse signal received at a second horizontal position as a second delay signal;

a delay value determiner circuit configured to generate a horizontal delay signal based on the first delay signal and the second delay signal; and a timing controller configured to determine generation times of line latch signals applied to a plurality of data lines based on the horizontal delay signal, wherein the first horizontal line is a dummy gate line, and wherein the first delay line and the second delay line are a first dummy data line and a second dummy data line, respectively.

18. The display device of claim 17 wherein the timing controller is configured to determine delay times of the line latch signals output from one driver IC of a plurality of driver ICs to be different from each other based on division information of the horizontal delay signal.

19. The display device of claim 17, further comprising a display panel including the first horizontal line.

20. The display device of claim 17, wherein the delay value determiner circuit includes a comparator to output a signal difference by comparing the first delay signal and the second delay signal; and a rectifier to generate the horizontal delay signal by rectifying a signal outputted from the comparator.

* * * * *